US011952988B2

(12) United States Patent
Kuboi et al.

(10) Patent No.: US 11,952,988 B2
(45) **Date of Patent: *Apr. 9, 2024**

(54) FLUID PRESSURE ROTATING MACHINE

(71) Applicant: KYB Corporation, Tokyo (JP)

(72) Inventors: Hiroaki Kuboi, Kanagawa (JP); Tetsuya Iwanaji, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 38 days.

This patent is subject to a terminal disclaimer.

(21) Appl. No.: 17/906,233

(22) PCT Filed: Mar. 11, 2021

(86) PCT No.: PCT/JP2021/009842

§ 371 (c)(1),
(2) Date: Sep. 13, 2022

(87) PCT Pub. No.: WO2021/240951

PCT Pub. Date: Dec. 2, 2021

(65) Prior Publication Data

US 2023/0122543 A1 Apr. 20, 2023

(30) Foreign Application Priority Data

May 26, 2020 (JP) ..... 2020-091536

(51) Int. Cl.
*F04B 1/324* (2020.01)
*F04B 1/2078* (2020.01)

(52) U.S. Cl.
CPC ..... *F04B 1/324* (2013.01); *F04B 1/2078* (2013.01)

(58) Field of Classification Search
CPC ..... F04B 1/2078; F04B 1/306; F04B 1/32; F04B 1/00; F04B 1/005; F04B 1/04;
(Continued)

(56) References Cited

U.S. PATENT DOCUMENTS 2,915,985 A * 12/1959 Budzich ..... F04B 49/08 92/57
3,221,660 A * 12/1965 Michael ..... F04B 1/324 417/222.1

(Continued)

FOREIGN PATENT DOCUMENTS

JP 2008-240518 A 10/2008

*Primary Examiner* — Essama Omgba
*Assistant Examiner* — Benjamin Doyle
(74) *Attorney, Agent, or Firm* — Rabin & Berdo, P.C.

(57) ABSTRACT

A piston pump includes: a first biasing mechanism configured to bias a swash plate in accordance with control pressure supplied; a second biasing mechanism configured to bias the swash plate against the first biasing mechanism; and a regulator configured to control the control pressure in accordance with self-pressure of the piston pump. The regulator has: an outer spring and an inner spring configured to be extended and compressed by following tilting of the swash plate; a control spool configured to be moved in accordance with biasing forces exerted by the outer spring and the inner spring, the control spool being configured to adjust the control pressure; an auxiliary spring configured to exert biasing force to the control spool against the biasing forces exerted by the outer spring and the inner spring; and an adjusting mechanism configured to adjust the biasing force exerted by the auxiliary spring.

6 Claims, 4 Drawing Sheets

(58) Field of Classification Search
CPC .... F04B 1/12; F04B 49/00; F04B 1/20; F04B 1/324; F04B 49/002; F04B 49/08
USPC ..... 417/375; 92/12, 13
See application file for complete search history.

(56) References Cited

U.S. PATENT DOCUMENTS 3,426,686 A * 2/1969 Anderson ..... F04B 1/324 417/218
3,738,779 A * 6/1973 Hein ..... F04B 49/08 91/506
3,788,773 A * 1/1974 Van der Kolk ..... F04B 49/002 417/217
3,830,594 A * 8/1974 Hein ..... F04B 1/324 417/217
4,028,010 A * 6/1977 Hopkins ..... F04B 1/324 417/217
4,072,442 A * 2/1978 Horiuchi ..... F04B 49/08 417/218
4,097,196 A * 6/1978 Habiger ..... F04B 49/08 417/222.1
4,212,596 A * 7/1980 Ruseff ..... F04B 49/007 60/486
4,355,510 A * 10/1982 Ruseff ..... F04B 1/08 60/452
4,379,389 A * 4/1983 Liesener ..... F04B 1/324 60/428
4,381,176 A * 4/1983 Kouns ..... F04B 49/02 417/222.1
4,381,647 A * 5/1983 Ruseff ..... F04B 49/002 60/452
5,207,751 A * 5/1993 Suzuki ..... F04B 1/324 60/443
5,251,537 A * 10/1993 Hoshino ..... F04B 1/324 91/506
6,033,188 A * 3/2000 Baldus ..... F04B 49/08 417/222.1
6,102,490 A * 8/2000 Ko ..... B60T 1/10 303/10
11,603,830 B2 * 3/2023 Akami ..... F04B 1/324
11,767,832 B2 * 9/2023 Takei ..... F04B 49/22 417/375
2002/0176784 A1 * 11/2002 Du ..... F04B 1/324 417/213
2014/0286798 A1 * 9/2014 Kato ..... F04B 27/1804 251/129.15
2014/0328700 A1 * 11/2014 Iwanaji ..... F04B 27/086 417/222.1
2018/0045185 A1 * 2/2018 Draper ..... F04B 1/324
2019/0136851 A1 * 5/2019 Sakai ..... E02F 9/2232

* cited by examiner

FLUID PRESSURE ROTATING MACHINE

TECHNICAL FIELD

The present invention relates to fluid pressure rotating machine.

BACKGROUND ART

JP2008-240518A discloses a swash plate type piston pump including a horsepower control regulator that controls a discharge pressure and a discharge flow rate by a fixed horsepower characteristic such that outputs are substantially fixed. This swash plate type piston pump includes, as tilting actuators for changing a tilting angle of the swash plate, a small-diameter piston that drives the swash plate in the direction in which the tilting angle is increased and a large-diameter piston that drives the swash plate in the direction in which the tilting angle is decreased.

The horsepower control regulator includes outer and inner control springs that press a feedback pin, which is to be displaced by following the swash plate, toward the swash plate side and a control spool that controls hydraulic pressure to be guided to a pressure chamber of the large-diameter piston. The outer and inner control springs are interposed between the feedback pin and the control spool. The control spool is slidably provided in a tubular valve housing. A plurality of ports formed in an outer circumference of the valve housing are made communicatable with an oil groove or signal pressure port of the control spool via a plurality of communication holes formed in the valve housing.

SUMMARY OF INVENTION

The horsepower control regulator disclosed in JP2008-240518A controls a hydraulic pressure to be guided to a pressure chamber of the large-diameter piston by the control spool that is moved according to a biasing force exerted by the outer and inner control springs. Thus, a control characteristic of the horsepower control regulator depends on the biasing force exerted by the outer and inner control springs. In other words, the biasing force exerted by the outer and inner control springs is set such that the horsepower control regulator exhibits the desired control characteristic.

In the above, because machining errors (dimensional errors) occur for the control spool, due to these errors, the compressed amount of the outer and inner control springs by the control spool and the feedback pin, in other words, the biasing force exerted by the outer and inner control springs may also be subjected to errors. Thus, there is a risk in that it is not possible to make the control characteristic of the horsepower control regulator to have the desired control characteristic, and a sufficient accuracy cannot be achieved for the horsepower control of a fluid pressure rotating machine.

An object of the present invention is to improve an accuracy of a horsepower control performed by a fluid pressure rotating machine.

According to an aspect of the present invention, a fluid pressure rotating machine is provided with: a cylinder block configured to be rotated together with a driving shaft; a plurality of cylinders formed in the cylinder block, the cylinders being arranged at predetermined intervals in a circumferential direction of the driving shaft; pistons respectively slidably inserted into the cylinders, the pistons each configured to define a capacity chamber in an interior of the cylinder; a tiltable swash plate configured to cause the pistons to reciprocate such that the capacity chambers are expanded and contracted; a first biasing mechanism configured to bias the swash plate in accordance with control pressure supplied; a second biasing mechanism configured to bias the swash plate against the first biasing mechanism; and a regulator configured to control the control pressure guided to the first biasing mechanism in accordance with self-pressure of the fluid pressure rotating machine. The regulator has: a biasing member configured to be extended and compressed by following tilting of the swash plate; a control spool configured to be moved in accordance with a biasing force from the biasing member, the control spool being configured to adjust the control pressure; an auxiliary biasing member configured to exert a biasing force to the control spool against the biasing force from the biasing member; and an adjusting mechanism configured to adjust the biasing force exerted by the auxiliary biasing member.

DESCRIPTION OF EMBODIMENTS

First Embodiment

In the following, a fluid pressure rotating machine 100 according to a first embodiment of the present invention will be described with reference to the drawings.

The fluid pressure rotating machine 100 functions as a piston pump capable of supplying working oil serving as working fluid by causing pistons 5 to reciprocate by rotating a shaft (a driving shaft) 1 by an externally supplied motive force. In addition, the fluid pressure rotating machine 100 functions as a piston motor capable of outputting a rotationally driving force by rotating the shaft 1 by causing the pistons 5 to reciprocate by fluid pressure of the externally supplied working oil. In the above, the fluid pressure rotating machine 100 may function only as the piston pump or only as the piston motor.

In the following description, a case in which the fluid pressure rotating machine 100 is used as the piston pump will be illustrated, and the fluid pressure rotating machine 100 is referred to as "a piston pump 100".

Figure 1:
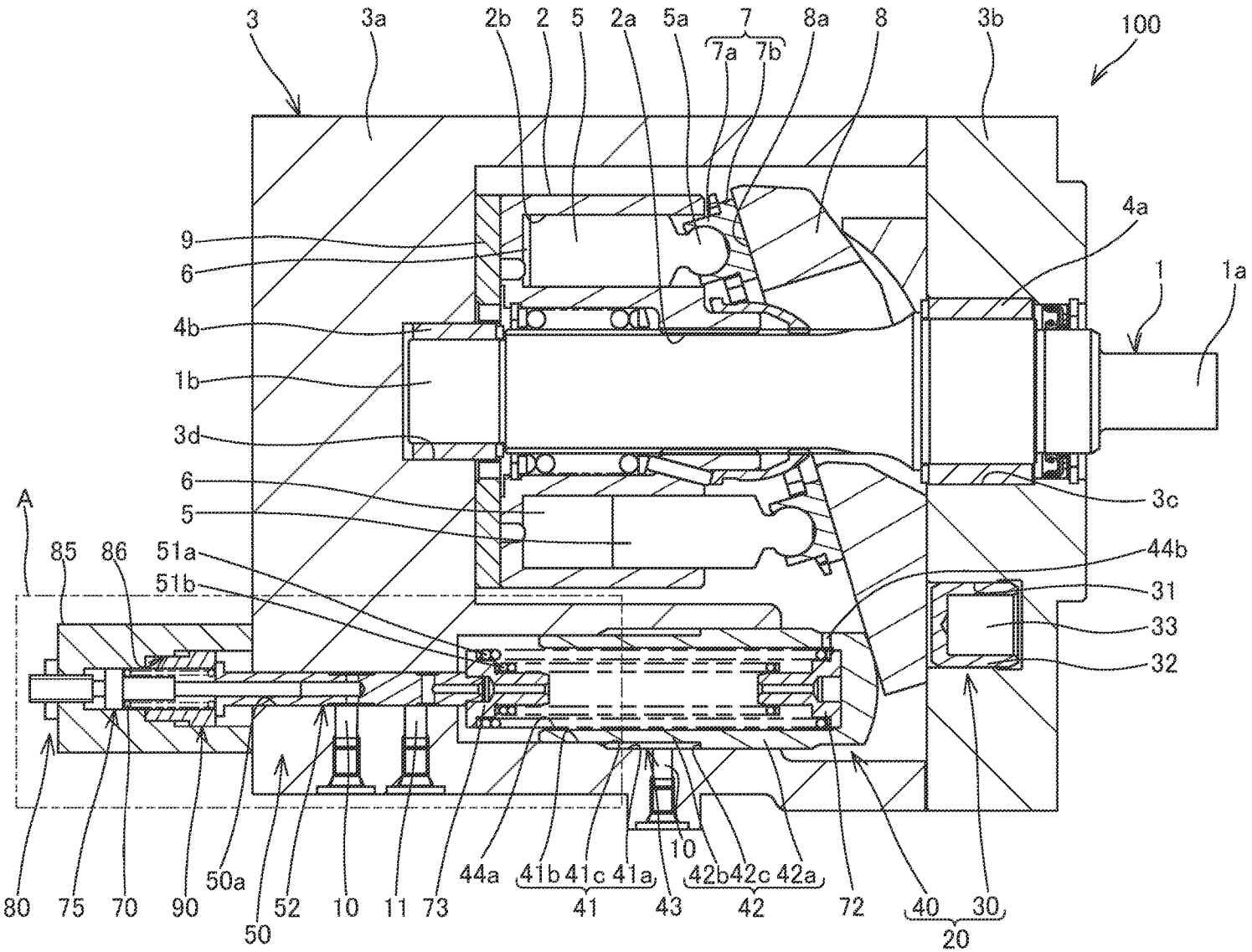
FIG. 1 is a sectional view of a fluid pressure rotating machine according to a first embodiment of the present invention.

The piston pump 100 is used as a hydraulic pressure source that supplies the working oil to an actuator (not shown) for driving a driving target, such as a hydraulic cylinder, etc., for example. As shown in FIG. 1, the piston pump 100 is provided with the shaft 1 that is rotated by a motive-power source, a cylinder block 2 that is linked to the shaft 1 and rotated together with the shaft 1, and a case 3 that accommodates the cylinder block 2.

The case 3 is provided with a bottomed tubular case main body 3*a* and a cover 3*b* that closes an opening end of the case main body 3*a* and through which the shaft 1 is inserted. An interior of the case 3 is communicated with a tank (not shown) through a drain passage (not shown). In the above, the interior the case 3 may be communicated with a suction passage (not shown), which will be described later.

One end portion 1*a* of the shaft 1 that is projected outside via an insertion hole 3*c* of the cover 3*b* is connected to the motive-power source (not shown) such as an engine, etc. The end portion 1*a* of the shaft 1 is rotatably supported by the insertion hole 3*c* of the cover 3*b* via a bearing 4*a*. Other end portion 1*b* of the shaft 1 is accommodated in a shaft accommodating hole 3*d* that is provided in a bottom portion of the case main body 3*a* and is rotatably supported via a bearing 4*b*. Although an illustration is omitted, a rotation shaft (not shown) of another hydraulic pump (not shown), such as a gear pump, etc., which is driven together with the piston pump 100 by the motive-power source, is connected to the other end portion 1*b* of the shaft 1 coaxially so as to be rotated together with the shaft 1.

The cylinder block 2 has a through hole 2*a* through which the shaft 1 is penetrated and the cylinder block 2 is spline-connected to the shaft 1 via the through hole 2*a*. With such a configuration, the cylinder block 2 is rotated together with the rotation of the shaft 1.

In the cylinder block 2, a plurality of cylinders 2*b* each having an opening portion on one end surface are formed so as to extend in parallel with the shaft 1. The plurality of cylinders 2*b* are formed at predetermined intervals in the circumferential direction of the cylinder block 2. In each of the cylinders 2*b*, the columnar piston 5 that defines a capacity chamber 6 is inserted so as to freely reciprocate. A tip end side of each piston 5 is projected from the opening portion of the cylinder 2*b*, and a spherical surface seat 5*a* is formed on a tip end portion thereof.

The piston pump 100 is further provided with shoes 7 that are each freely rotatably coupled with the spherical surface seat 5*a* of the piston 5 and in sliding contact with the spherical surface seat 5*a*, a swash plate 8 that is in sliding contact with the shoes 7 along with the rotation of the cylinder block 2, and a valve plate 9 provided between the cylinder block 2 and the bottom portion of the case main body 3*a*.

Each of the shoes 7 is provided with a receiving portion 7*a* that receives the spherical surface seat 5*a* that is formed on the tip end of each piston 5 and a circular flat plate portion 7*b* that is in sliding contact with a sliding contact surface 8*a* of the swash plate 8. An inner surface of the receiving portion 7*a* is formed to have a spherical surface shape and is brought into sliding contact with an outer surface of the received spherical surface seat 5*a*. With such a configuration, the shoes 7 can undergo angular displacement in any directions with respect to the spherical surface seats 5*a*.

In order to make a discharge amount of the piston pump 100 variable, the swash plate 8 is supported by the cover 3*b* so as to be tiltable. The flat plate portions 7*b* of the shoes 7 are in surface contact with the sliding contact surface 8*a*.

The valve plate 9 is a circular plate member with which a base end surface of the cylinder block 2 is brought into sliding contact and is fixed to the bottom portion of the case main body 3*a*. Although not shown in the figures, the valve plate 9 is formed with a suction port that connects the suction passage formed in the cylinder block 2 with the capacity chambers 6 and a discharge port that connects a discharge passage formed in the cylinder block 2 with the capacity chambers 6.

The piston pump 100 is further provided with a tilting mechanism 20 that tilts the swash plate 8 in accordance with the fluid pressure and a regulator 50 that controls the fluid pressure to be guided to the tilting mechanism 20 in accordance with a tilting angle of the swash plate 8.

The tilting mechanism 20 has a first biasing mechanism 30 that biases the swash plate 8 in the direction in which the tilting angle is decreased and a second biasing mechanism 40 that biases the swash plate 8 in the direction in which the tilting angle is increased. In other words, the second biasing mechanism 40 biases the swash plate 8 against the first biasing mechanism 30.

The first biasing mechanism 30 has a large-diameter piston 32 that is slidably inserted into a first piston accommodating hole 31 formed in the cover 3*b* and is brought into contact with the swash plate 8 and a control pressure chamber 33 that is defined by the large-diameter piston 32 in the first piston accommodating hole 31.

The fluid pressure (hereinafter, referred to as "the control pressure") regulated by the regulator 50 is guided to the control pressure chamber 33. The large-diameter piston 32 biases the swash plate 8 in the direction in which the tilting angle is decreased by the control pressure guided to the control pressure chamber 33.

The second biasing mechanism 40 has: a small-diameter piston 42 serving as a control piston that is slidably inserted into a second piston accommodating hole 41 formed in the case main body 3*a* so as to come into contact with the swash plate 8; and a pressure chamber 43 that is defined by the small-diameter piston 42 in the second piston accommodating hole 41.

The small-diameter piston 42 has a first sliding portion 42*a*, a second sliding portion 42*b* having an outer diameter smaller than that of the first sliding portion 42*a*, and a step surface 42*c* formed by a difference between the outer diameters of the first sliding portion 42*a* and the second sliding portion 42*b*.

The second piston accommodating hole 41 has: a first accommodating portion 41*a* with which the first sliding portion 42*a* of the small-diameter piston 42 is brought into sliding contact; a second accommodating portion 41*b* that has the inner diameter smaller than that of the first accommodating portion 41*a* and with which the second sliding portion 42*b* is brought into sliding contact; and a step surface 41*c* that is formed by a difference between the inner diameters of the first accommodating portion 41*a* and the second accommodating portion 41*b*. The first accommodating portion 41*a* opens to the interior of the case 3. The pressure chamber 43 is defined by: an outer circumferential surface of the second sliding portion 42*b* and the step surface 42*c* of the small-diameter piston 42; and an inner circumferential surface of the first accommodating portion 41*a* and the step surface 41*c* of the second piston accommodating hole 41. In other words, the pressure chamber 43 is an annular space formed on the outer circumference of the small-diameter piston 42.

Discharge pressure (self-pressure) from the piston pump 100 is always guided to the pressure chamber 43 through a discharge pressure passage 10 formed in the case main body 3*a*. The small-diameter piston 42 biases the swash plate 8 in the direction in which the tilting angle is increased by receiving the discharge pressure guided to the pressure chamber 43. The step surface 42*c* formed on the outer circumference of the small-diameter piston 42 is a pressure receiving surface of the small-diameter piston 42 that receives the discharge pressure guided to the pressure chamber 43.

In addition, in the small-diameter piston 42, a spring accommodating hole 44*a* that accommodates one end portions of an outer spring 51*a* and an inner spring 51*b*, which will be described later, is formed on an end portion on the opposite side from the swash plate 8. Furthermore, the small-diameter piston 42 is formed with a communication hole 44*b* through which the spring accommodating hole 44*a* and the interior of the case 3 are communicated. Thus, the interior of the spring accommodating hole 44*a* and the interior of the second piston accommodating hole 41 are in communication with a tank through the communication hole 44*b* and the interior of the case 3.

The large-diameter piston 32 is formed to have a pressure receiving area for the control pressure that is larger than that of the small-diameter piston 42. As shown in FIG. 1, the large-diameter piston 32 is provided on the other side from the small-diameter piston 42 with respect to the swash plate 8. In other words, the large-diameter piston 32 is arranged such that its position in the circumferential direction with respect to the center axis of the shaft 1 substantially coincides with the small-diameter piston 42.

The regulator 50 regulates the control pressure to be guided to the control pressure chamber 33 in accordance with the discharge pressure from the piston pump 100, thereby controlling horsepower (output) of the piston pump 100.

The regulator 50 has: the outer spring 51*a* and the inner spring 51*b*, each serving as a biasing member that biases the small-diameter piston 42 toward the swash plate 8; a control spool 52 that is moved in accordance with the biasing force exerted by the outer spring 51*a* and the inner spring 51*b* so as to adjust the control pressure; an auxiliary spring 70 serving as an auxiliary biasing member that exerts the biasing force to the control spool 52 against the biasing force exerted to the control spool 52 by the outer spring 51*a* and the inner spring 51*b*; an adjusting mechanism 80 that adjusts the biasing force exerted by the auxiliary spring 70; and a stopper 90 that restricts the movement of the control spool 52 by the biasing force exerted by the outer spring 51*a* and the inner spring 51*b* beyond a predetermined range.

The outer spring 51*a* and the inner spring 51*b* are each a coil spring and are extended and compressed so as to follow the tilting of the swash plate 8. The inner spring 51*b* has the coiling diameter smaller than that of the outer spring 51*a* and is provided on the inner side of the outer spring 51*a*. The one end portions of the outer spring 51*a* and the inner spring 51*b* are accommodated in the spring accommodating hole 44*a* of the small-diameter piston 42 and are seated on a bottom portion of the spring accommodating hole 44*a* via a spring seat 72. The other end portions of the outer spring 51*a* and the inner spring 51*b* are seated on an end surface of the control spool 52 via a spring seat 73. The spring seat 72 on one side is moved together with the small-diameter piston 42, and the spring seat 73 on the other side is moved together with the control spool 52.

In a state in which the tilting angle of the swash plate 8 is maximized (the state shown in FIG. 1), the spring seat 73 on the other side is not in contact with a bottom portion of the second accommodating portion 41*b* of the second piston accommodating hole 41, and the spring seat 73 is maintained at a floating state in which the spring seat 73 is separated away from the bottom portion of the second accommodating portion 41*b*.

The natural length (a free length) of the outer spring 51*a* is longer than the natural length of the inner spring 51*b*. In a state in which the tilting angle of the swash plate 8 is maximized (the state shown in FIG. 1), while the outer spring 51*a* is compressed by the spring seat 72, the inner spring 51*b* is in a state in which any end portion thereof is separated away from the spring seat (the spring seat 72 in FIG. 1) and the inner spring 51*b* is floated (the state in which the inner spring 51*b* has the natural length). In other words, when the tilting angle of the swash plate 8 is decreased from the maximum state, only the outer spring 51*a* is compressed at the beginning. Once the outer spring 51*a* is compressed to the point at which the length of the outer spring 51*a* is shorter than the natural length of the inner spring 51*b*, both of the outer spring 51*a* and the inner spring 51*b* are compressed. Thus, a configuration in which an elastic force exerted by the outer spring 51*a* and the inner spring 51*b* to the swash plate 8 via the small-diameter piston 42 is increased stepwise is achieved.

In the case main body 3*a*, a spool accommodating hole 50*a* into which the control spool 52 is slidably inserted is formed. The spool accommodating hole 50*a* is formed coaxially with the second piston accommodating hole 41 accommodating the small-diameter piston 42 and is provided so as to communicate with the second piston accommodating hole 41 (more specifically, the second accommodating portion 41*b*).

In addition, in the case main body 3*a*, the discharge pressure passage 10 to which the discharge pressure from the piston pump 100 is guided and a control pressure passage 11 that guides the control pressure to the control pressure chamber 33 of the large-diameter piston 32 are formed. The discharge pressure from the piston pump 100 is always guided to the discharge pressure passage 10. The control pressure passage 11 communicates with the control pressure chamber 33 through a cover-side passage (not shown) formed in the cover 3*b*.

The spool accommodating hole 50*a* opens at an end surface of the case main body 3*a*. The opening of the spool accommodating hole 50*a* at the end surface of the case main body 3*a* is closed by a cap 85.

Figure 2:
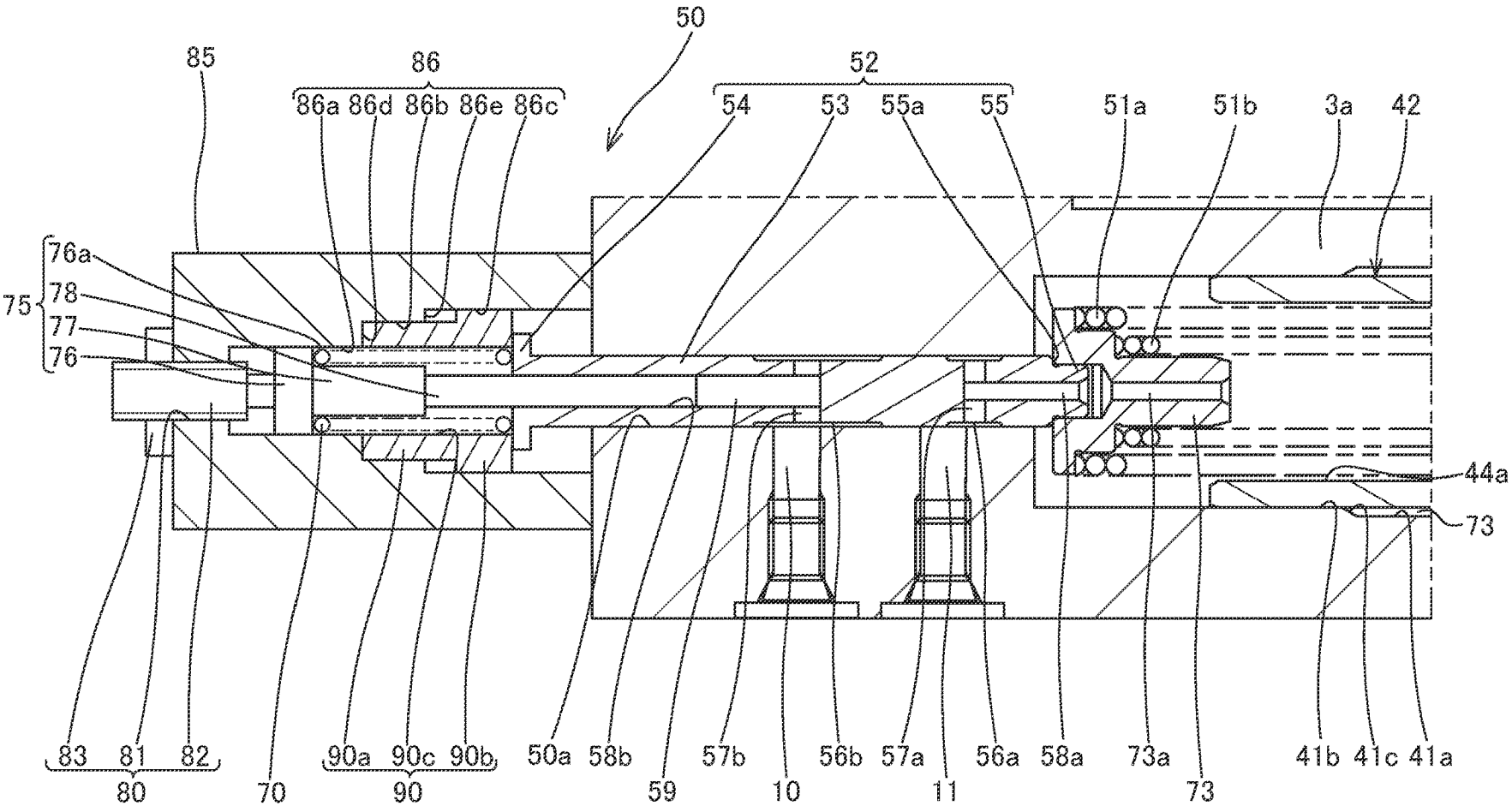
FIG. 2 is a diagram showing the configuration of a regulator of the fluid pressure rotating machine according to the first embodiment of the present invention and is an enlarged sectional view of a part A in FIG. 1.

As shown in FIG. 2, the cap 85 is formed with a concave portion 86 that accommodates one end portion of the control spool 52. The concave portion 86 has a first concave portion 86*a*, a second concave portion 86*b* having the inner diameter larger than that of the first concave portion 86*a*, and a third concave portion 86*c* having the inner diameter larger than that of the second concave portion 86*b*. A first concave portion step surface 86*d* is formed by a difference between the inner diameters of the first concave portion 86*a* and the second concave portion 86*b*. A second concave portion step surface 86*e* is formed by a difference between the inner diameters of the second concave portion 86*b* and the third concave portion 86*c*. The third concave portion 86*c* faces the end surface of the case main body 3*a*.

The control spool 52 has a main body portion 53 that is in sliding contact with an inner circumferential surface of the spool accommodating hole 50*a*, a flange portion 54 that is provided on the one end portion of the main body portion 53 and that is formed to have the outer diameter larger than that of the main body portion 53, and a projected portion 55 that is provided on the other end portion of the main body portion 53 on the opposite side from the flange portion 54 and inserted into the spring seat 73.

The flange portion 54 is accommodated in the third concave portion 86*c* of the cap 85. The projected portion 55 is formed to have the outer diameter smaller than that of the main body portion 53, and a step surface 55*a*, which is formed by a difference between the outer diameters of the main body portion 53 and the projected portion 55, is brought into contact with the spring seat 73.

A first control port 56*a* and a second control port 56*b*, each serving as an annular groove, are formed in an outer circumference of the control spool 52. In addition, in the control spool 52, a first control passage 57*a* in communication with the first control port 56*a* and a second control passage 57*b* in communication with the second control port 56*b* are each formed so as to penetrate through the control spool 52 in the radial direction.

The control spool 52 is formed with an axial direction passage 58*a* that is provided along the axial direction from the one end portion (the projected portion 55) and a shaft-portion insertion hole 58*b* that is provided along the axial direction from the other end portion (the flange portion 54) and into which a shaft portion 78, which will be described later, is inserted. Through the axial direction passage 58*a*, the first control passage 57*a* is communicated with a connection passage 73*a* that is formed in the spring seat 73 and in communication with the spring accommodating hole 44*a* (the second piston accommodating hole 41). The shaft-portion insertion hole 58*b* is communicated with the second control passage 57*b*.

As described above, the first control passage 57*a* is communicated with the interior of the case 3 via the axial direction passage 58*a*, the connection passage 73*a* of the spring seat 73, and the spring accommodating hole 44*a* and the communication hole 44*b* of the small-diameter piston 42. Thus, the pressure in the first control passage 57*a* is equalized to the tank pressure.

The stopper 90 has a cylindrical first stopper portion 90*a* that is inserted into the second concave portion 86*b* of the concave portion 86 of the cap 85 and a second stopper portion 90*b* that is inserted into the third concave portion 86*c* of the concave portion 86 of the cap 85 and that has the outer diameter larger than that of the first stopper portion 90*a*. In the stopper 90, a center hole 90*c* is formed so as to extend through the axial center along the axial direction. In the state in which the tilting angle of the swash plate 8 is maximized as shown in FIG. 1, the flange portion 54 of the control spool 52 is brought into contact with an end surface of the second stopper portion 90*b* of the stopper 90. In addition, in the stopper 90, the first stopper portion 90*a* is pressed so as to come into contact with the first concave portion step surface 86*d* of the concave portion 86 by the biasing force from the outer spring 51*a* transmitted via the control spool 52. Thereby, the movement of the control spool 52 in the left direction in the figure by the biasing force from the outer spring 51*a* beyond a predetermined range is restricted by the stopper 90.

The auxiliary spring 70 is a coil spring. The one end of the auxiliary spring 70 is seated on a seat member 75 accommodated in the concave portion 86 of the cap 85, and the other end thereof is seated on the flange portion 54 of the control spool 52. The auxiliary spring 70 is provided so as to extend in the center hole 90*c* of the stopper 90 and in a state in which it is compressed between the seat member 75 and the flange portion 54 of the control spool 52.

The seat member 75 has a plate-shaped base portion 76 that is in sliding contact with an inner circumferential surface of the first concave portion 86*a* of the concave portion 86 of the cap 85, a support portion 77 that projects from the base portion 76 in the axial direction to support an inner circumference of the auxiliary spring 70, and the shaft portion 78 that projects from a tip end of the support portion 77 in the axial direction and that is inserted into the shaft-portion insertion hole 58*b* of the control spool 52. The one end portion of the auxiliary spring 70 is seated on a step surface (an end surface of the base portion 76 on the support portion 77 side) 76*a* formed by a difference between the outer diameters of the base portion 76 and the support portion 77.

By slidably inserting the shaft portion 78 of the seat member 75 into the shaft-portion insertion hole 58*b* of the control spool 52, a signal pressure chamber 59 is formed by the shaft-portion insertion hole 58*b* and the shaft portion 78. The discharge pressure guided to the second control passage 57*b* is then guided to the signal pressure chamber 59 of the control spool 52 as signal pressure and acts on an inner wall portion of the second control passage 57*b* facing the shaft portion 78. The control spool 52 receives the discharge pressure at a pressure receiving area corresponding to the cross-sectional area of the shaft portion 78 (the shaft-portion insertion hole 58*b*), and thereby, the control spool 52 is biased by the discharge pressure in the direction in which the outer spring 51*a* and the inner spring 51*b* are compressed.

The adjusting mechanism 80 has: an internal thread hole 81 that is formed in the cap 85; a screw member 82 that is threaded to the internal thread hole 81 and moves the seat member 75 back and forth in the biasing direction of the auxiliary spring 70; and a nut 83 that fixes a threaded position of the screw member 82 with respect to the internal thread hole 81.

The internal thread hole 81 is formed so as to penetrate through a bottom portion of the first concave portion 86*a* of the concave portion 86 and opens to the first concave portion 86*a*.

The screw member 82 is brought into contact with the base portion 76 on the other side in the axial direction from the end surface 76*a* on which the auxiliary spring 70 is seated. By adjusting the threaded position between the screw member 82 and the internal thread hole 81, the screw member 82 is moved back and forth with respect to the seat member 75 in the axial direction (the direction of the biasing force from the auxiliary spring 70). In other words, by moving the screw member 82 back and forth, the seat member 75 is moved back and forth such that the auxiliary spring 70 is extended and compressed, and thereby, it is possible to adjust a set load (initial load) of the auxiliary spring 70. With such a configuration, the regulator 50 is configured such that the biasing force exerted by the auxiliary spring 70 can be adjusted. As the nut 83 is threaded to the screw member 82 and tightened against the cap 85, the threaded position of the screw member 82 with respect to the internal thread hole 81 is fixed.

As described above, the control spool 52 is biased in the direction away from the swash plate 8 (the left direction in the figure) by the biasing force exerted by the outer spring 51*a* and the inner spring 51*b*. In addition, the control spool 52 is biased in the direction approaching the swash plate 8 by the discharge pressure guided from the piston pump 100 to the signal pressure chamber 59 and by the biasing force exerted by the auxiliary spring 70. In other words, the control spool 52 is moved such that the biasing force is balanced between the outer spring 51*a* and the inner spring 51*b*, the auxiliary spring 70, and the discharge pressure from the piston pump 100.

Specifically, the control spool 52 is moved between two positions, i.e. between a first position and a second position. FIGS. 1 and 2 show a state in which the control spool 52 is positioned at the second position (the same applies to FIGS. 3 and 4, which will be described later). The position of the control spool 52 is switched from the second position shown in FIGS. 1 and 2 to the first position as the control spool 52 is moved to the right direction in the figure.

The first position is a position at which the tilting angle of the swash plate 8 is decreased to reduce the discharge capacity of the piston pump 100. When the control spool 52 is positioned at the first position, the discharge pressure passage 10 in the case main body 3*a* is communicated with the control pressure passage 11 via the second control port 56*b* of the control spool 52, and the communication between the first control passage 57*a* of the control spool 52 and the control pressure passage 11 is shut off. Thus, when the control spool 52 is positioned at the first position, the discharge pressure from the piston pump 100 is guided to the control pressure chamber 33 of the first biasing mechanism 30.

The second position is a position at which the tilting angle of the swash plate 8 is increased to increase the discharge capacity of the piston pump 100. When the control spool 52 is positioned at the second position, the control pressure passage 11 is communicated with the first control passage 57*a* of the control spool 52 via the first control port 56*a*, and the communication between the discharge pressure passage 10 and the control pressure passage 11 is shut off. Thus, when the control spool 52 is positioned at the second position, the tank pressure is guided to the control pressure chamber 33.

Next, the effects of the piston pump 100 will be described.

In the piston pump 100, a horsepower control is performed such that the discharge capacity of the piston pump 100 (the tilting angle of the swash plate 8) is controlled so as to maintain the discharge pressure from the piston pump 100 constant by the regulator 50.

The control spool 52 of the regulator 50 is biased by the biasing force by the discharge pressure from the piston pump 100 and the biasing force exerted by the auxiliary spring 70 so as to be positioned at the first position, and the control spool 52 is biased by the biasing force exerted by the outer spring 51*a* and the inner spring 51*b* so as to be positioned at the second position.

In a state in which the discharge pressure from the piston pump 100 and the biasing force exerted by the auxiliary spring 70 are maintained so as to be equal to or lower than the biasing force from the outer spring 51*a*, the control spool 52 of the regulator 50 is positioned at the second position, and the tilting angle of the swash plate 8 is maintained at the maximum angle (see FIG. 1).

The discharge pressure from the piston pump 100 is increased as a load of a hydraulic cylinder driven by the discharge pressure from the piston pump 100 is increased. As the discharge pressure from the piston pump 100 is increased in the state in which the tilting angle of the swash plate 8 is maintained at the maximum angle, the resultant force of the discharge pressure and the biasing force exerted by the auxiliary spring 70 comes to exceed the biasing force from the outer spring 51*a*. Thereby, the control spool 52 is moved in the direction (the right direction in the figure) in which the position of the control spool 52 is switched from the second position to the first position. When the control spool 52 is moved to the first position, the discharge pressure is guided to the control pressure passage 11 from the discharge pressure passage 10, and therefore, the control pressure is increased. More specifically, as the control spool 52 is moving toward the first position, an opening area (flow passage area) of the second control port 56*b* of the control spool 52 to the control pressure passage 11 is increased. Thus, as a moving amount of the control spool 52 in the direction in which the position of the control spool 52 is switched to the first position (the right direction in the figure) is increased, the control pressure guided to the control pressure passage 11 is increased. As the control pressure guided to the control pressure passage 11 is increased, the large-diameter piston 32 (see FIG. 1) is moved toward the swash plate 8, and the swash plate 8 is tilted in the direction in which the tilting angle is decreased. Thus, the discharge capacity of the piston pump 100 is reduced.

As the swash plate 8 is tilted in the direction in which the tilting angle is decreased, the small-diameter piston 42 is moved in the left direction in the figure by following the swash plate 8 so as to compress the outer spring 51*a* and the inner spring 51*b*. In other words, as the swash plate 8 is tilted in the direction in which the tilting angle is decreased, the small-diameter piston 42 is moved so as to bias the control spool 52 via the outer spring 51*a* (and the inner spring 51*b*) in the direction in which the position of the control spool 52 is switched to the second position. Thereby, as the control spool 52 is pushed buck and moved in the direction in which the position of the control spool 52 is switched to the second position, the control pressure supplied to the control pressure chamber 33 through the control pressure passage 11 is decreased. As the control pressure is decreased, when the biasing force imparted to the swash plate 8 by the control pressure is balanced with the biasing force imparted to the swash plate 8 by the outer spring 51*a* (and the inner spring 51*b*), the movement of the large-diameter piston 32 (the tilting of the swash plate 8) is stopped. As described above, as the discharge pressure from the piston pump 100 is increased, the discharge capacity is reduced.

Conversely, the discharge pressure from the piston pump 100 is decreased as the load of the hydraulic cylinder driven by the discharge pressure from the piston pump 100 is decreased. As the discharge pressure from the piston pump 100 is decreased, the resultant force of the discharge pressure from the piston pump 100 and the biasing force exerted by the auxiliary spring 70 comes to fall below the biasing force exerted by the outer spring 51*a* and the inner spring 51*b*. Thereby, the control spool 52 is moved in the direction in which the position of the control spool 52 is switched from the first position to the second position. When the control spool 52 is moved to the second position, because the control pressure passage 11 is communicated with the first control passage 57*a* under the tank pressure, the control pressure is decreased. As the control pressure is decreased, the swash plate 8 is tilted in the direction in which the tilting angle is increased by the small-diameter piston 42 that receives the biasing force exerted by the outer spring 51*a* and the inner spring 51*b*.

As the swash plate 8 is tilted in the direction in which the tilting angle is increased, the small-diameter piston 42 receiving the biasing force exerted by the outer spring 51*a* and the inner spring 51*b* is moved in the right direction in the figure by following the swash plate 8 such that the outer spring 51*a* and the inner spring 51*b* are extended. Thereby, the biasing force received by the control spool 52 from the outer spring 51*a* and the inner spring 51*b* is decreased. Therefore, the control spool 52 is moved in the direction in which the outer spring 51*a* and the inner spring 51*b* are compressed by receiving the discharge pressure guided to the second control passage 57*b*. In other words, the control spool 52 is moved in the direction in which the position of the control spool 52 is switched from the second position to the first position so as to follow the small-diameter piston 42. When the control spool 52 is positioned at the first position again and the control pressure is increased, and the biasing force imparted to the swash plate 8 by the control pressure is balanced with the biasing force imparted to the swash plate 8 by the outer spring 51*a* (and the inner spring 51*b*), then the movement of the large-diameter piston 32 (the tilting of the swash plate 8) is stopped. As described above, as the discharge pressure from the piston pump 100 is decreased, the discharge capacity is increased.

As described above, the horsepower control is performed such that the discharge capacity of the piston pump 100 is reduced as the discharge pressure from the piston pump 100 is increased, and such that the discharge capacity is increased as the discharge pressure is decreased.

For ease of understanding the present invention, a regulator 250 according to a comparative example of the present invention will be described with reference to FIG. 4. Configurations that are similar to those in the above-mentioned embodiment are assigned the same reference signs as those in the above-mentioned embodiment, and descriptions thereof shall be omitted.

The regulator 250 according to the comparative example has a sleeve 260 that is attached to an attachment hole 3*e* formed in the case main body 3*a*. In addition, in the comparative example, the auxiliary spring 70 and the adjusting mechanism 80 in this embodiment are not provided.

The sleeve 260 is attached to the case main body 3*a* by being threaded to an internal thread 203 that is formed in the attachment hole 3*e* of the case main body 3*a*. The sleeve 260 is formed with a spool accommodating hole 250*a* into which the control spool 52 is inserted. In addition, the sleeve 260 is formed with a first communication hole 261*a* that communicates with the control pressure passage 11 through a first port 260*a* formed on an outer circumference of the sleeve 260 and a second communication hole 261*b* that communicates with the discharge pressure passage 10 through a second port 260*b* formed on the outer circumference of the sleeve 260. The first port 260*a* and the second port 260*b* are each an annular groove that is formed on the outer circumferential surface of the sleeve 260. The first communication hole 261*a* and the second communication hole 261*b* respectively intersect the spool accommodating hole 250*a* and communicate with the spool accommodating hole 250*a*.

Similarly to the above-mentioned embodiment, the one end of the spool accommodating hole 250*a* formed in the sleeve 260 opens to the second piston accommodating hole 41 that accommodates the small-diameter piston 42. The other end of the spool accommodating hole 250*a* is closed by a plug 270 that is attached by being threaded to the sleeve 260. In addition, the plug 270 has a shaft portion 278 that is inserted into the shaft-portion insertion hole 58*b* formed in the control spool 52. The shaft portion 278 of the plug 270 has a configuration corresponding to that of the shaft portion 78 in the above-mentioned embodiment.

In the comparative example, at the first position, the first communication hole 261*a* of the sleeve 260 is communicated with the second communication hole 261*b* through the second control port 56*b* of the control spool 52, and the communication between the first control passage 57*a* of the control spool 52 and the first communication hole 261*a* is shut off. Thus, at the first position, the discharge pressure from the piston pump 100 is guided to the control pressure chamber 33 of the first biasing mechanism 30.

At the second position, the first communication hole 261*a* is communicated with the first control passage 57*a* of the control spool 52 through the first control port 56*a*, and the communication between the first communication hole 261*a* and the second communication hole 261*b* is shut off. Thus, at the second position, the tank pressure is guided to the control pressure chamber 33.

In the above, because machining errors (dimensional errors) occur for the control spool and the outer spring, due to these errors, there is a risk in that errors also occur for the set load of the outer spring. Due to the error for the set load of the outer spring, there is a risk in that errors also occur for a control characteristic of the regulator for the tilting angle of the swash plate with respect to variation in the load of the piston pump (in other words, the horsepower control characteristic).

With the regulator 250 according to the comparative example, it is possible to adjust the set load of the outer spring 51*a* by causing the outer spring 51*a* to be extended and compressed by adjusting the threaded position of the sleeve 260 with respect to the case main body 3*a* to move the sleeve 260 and the control spool 52 accommodated in the sleeve 260 back and forth relative to the outer spring 51*a*. With such means, in the comparative example, it is possible to realize the desired control characteristic by adjusting the errors for the control characteristic of the regulator 250 due to the machining errors for the control spool 52.

However, in the comparative example, the control pressure passage 11 and the discharge pressure passage 10, which are formed in the case main body 3*a*, need to be in communication with the first port 260*a* and the second port 260*b*, which are formed in the sleeve 260, respectively, all the time. Thus, with the configuration as in the comparative example in which the sleeve 260 is moved to adjust the control characteristic, the sleeve 260 can only be moved within a range in which the hole in the sleeve 260 and the passage in the case main body 3*a* are communicated with each other, and the adjustment level of the control characteristic is limited. In other words, in the comparative example, the restriction in the relative positional relationship of the case main body 3*a* with the sleeve 260 and the control spool 52 causes limitations to the adjustment level of the control characteristic (adjusting range).

In contrast, in this embodiment, as described above, the control spool 52 is moved such that the biasing force by the discharge pressure (the self-pressure) from the piston pump 100, the biasing force exerted by the outer spring 51*a* and the inner spring 51*b*, and the biasing force exerted by the auxiliary spring 70 are balanced, and thereby, the control pressure is adjusted. By doing so, the horsepower control is performed on the piston pump 100. In other words, the characteristic of the horsepower control performed by the regulator 50 is affected by the biasing force exerted by the outer spring 51*a* and the inner spring 51*b* and the biasing force exerted by the auxiliary spring 70.

In this embodiment, the configuration in which the control characteristic is adjusted by extending and compressing the outer spring 51*a* (in other words, by adjusting the set load of the outer spring 51*a*) is not employed, but the configuration in which the control characteristic is adjusted by adjusting the biasing force from the auxiliary spring 70 (the set load) by the adjusting mechanism 80 is employed. By adjusting the biasing force from the auxiliary spring 70 by the adjusting mechanism 80, it is possible to adjust the control characteristic without changing the relative positional relationship between the control spool 52 and the case main body 3*a*, in other words, without extending and compressing the outer spring 51*a*. Thus, the control characteristic can be adjusted without being affected by the restriction in the relative positional relationship between the control spool 52 and the case main body 3*a*, and therefore, it is possible to realize the desired control characteristic with a higher accuracy.

It is possible to adjust the control characteristic not only for adjusting the errors for the control characteristic due to the machining errors for the control spool 52, but also in accordance with applications in which the piston pump 100 is to be used.

The biasing force exerted by the auxiliary spring 70 is set in accordance with a specification of the piston pump 100, the application of the piston pump 100 (in other words, a specification of the actuator in which the working oil is supplied from the piston pump 100), a specification of the motive-power source (for example engine), and so forth. In addition, it is desirable that the biasing force from the auxiliary spring 70 (the set load) be adjusted by the adjusting mechanism 80 within a range not exceeding the resultant force of the biasing force exerted by the outer spring 51*a* and the inner spring 51*b* regardless of the tilting angle of the swash plate 8. In other words, it is desirable that the maximum set load exerted by the auxiliary spring 70 be set so as to be smaller than the biasing force exerted by the outer spring 51*a* in a state in which the tilting angle of the swash plate 8 is the largest (the state shown in FIG. 1). By doing so, the biasing force exerted by the outer spring 51*a* and the inner spring 51*b* becomes dominant as the factor for defining the control characteristic. In addition, by adjusting (increasing) the biasing force from the auxiliary spring 70, it is possible to prevent the movement of the control spool 52 so as to compress the outer spring 51*a*. Thus, it is possible to prevent the communicating state between the passage formed in the case main body 3*a* and the port formed in the control spool 52 from being changed unintentionally by the adjustment of the biasing force from the auxiliary spring 70.

Figure 4:
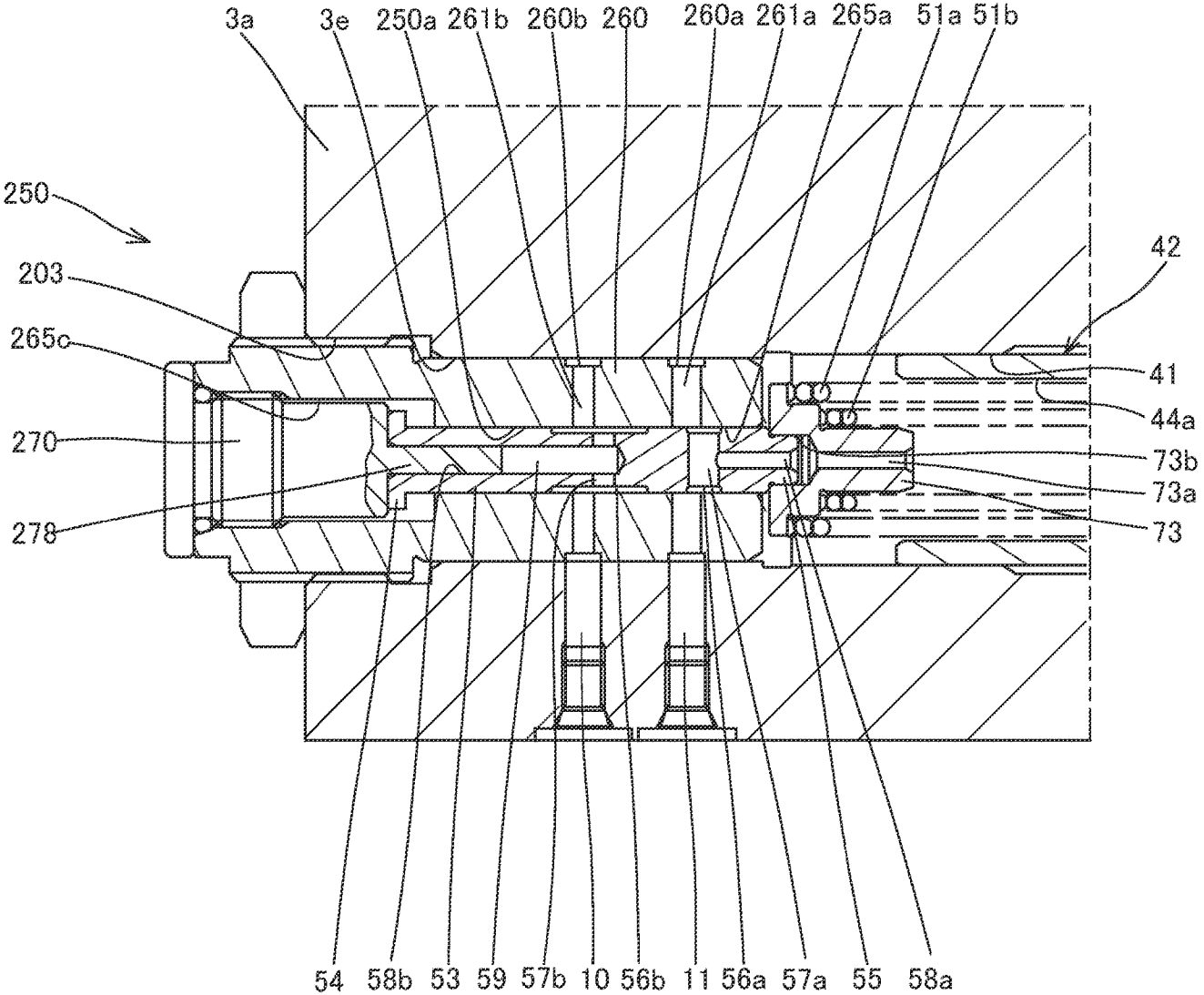
FIG. 4 is an enlarged sectional view showing the configuration of the regulator of the fluid pressure rotating machine according to a comparative example of the present invention.

In addition, in the comparative example shown in FIG. 4, the sleeve 260 is inserted into the attachment hole 3*e* of the case main body 3*a*, and the control spool 52 is inserted into the spool accommodating hole 250*a* of the sleeve 260. Therefore, in the comparative example, leakage of the working oil may be caused at two locations, i.e. between the case main body 3*a* and the sleeve 260, and between the sleeve 260 and the control spool 52. In contrast, the sleeve 260 as in the comparative example is not provided in this embodiment, and the control spool 52 is directly inserted into the spool accommodating hole 50*a* formed in the case main body 3*a*. Thus, the number of locations where the leakage of the working oil may be caused is reduced compared with the comparative example, and therefore, it is possible to suppress the leakage of the working oil. In addition, in this embodiment, because the sleeve 260 is not provided and the number of parts is less than that for the comparative example, it is possible to reduce the cost and to the size of the piston pump 100.

In the above, it suffices that the piston pump 100 is configured so as to at least adjust the biasing force from the auxiliary spring 70 by the adjusting mechanism 80, and it is not essential to employ the configuration in which the control spool 52 is directly inserted into the spool accommodating hole 50*a* formed in the case main body 3*a*. The piston pump 100 may have, for example, the sleeve 260 of the comparative example shown in FIG. 4. In other words, the configuration, in which the adjusting mechanism 80 of this embodiment is provided on the comparative example shown in FIG. 4, and the biasing force from the auxiliary spring 70 is adjusted by the adjusting mechanism 80, is also within the scope of the present invention.

According to the embodiment mentioned above, the advantages described below are afforded.

With the piston pump 100, it is possible to adjust the control characteristic of the regulator 50 by adjusting the biasing force from the auxiliary spring 70 by the adjusting mechanism 80. Thus, even if the errors occur for the control characteristic due to the machining errors for the control spool 52, etc., it is possible to realize the desired control characteristic with a high accuracy by adjusting the biasing force from the auxiliary spring 70.

In addition, with the piston pump 100, because the piston pump 100 has the configuration in which the biasing force from the auxiliary spring 70 is adjusted by the adjusting mechanism 80, it is possible to adjust the control characteristic of the regulator 50 without adjusting the set load of the outer spring 51*a* and the inner spring 51*b*. Therefore, it is possible to adjust the control characteristic without being affected by the restriction in the relative positional relationship between the control spool 52 and the case main body 3*a*, and to realize the desired control characteristic with a higher accuracy.

In addition, with the piston pump 100, the biasing force from the auxiliary spring 70 (the set load) is set within a range not exceeding the resultant force of the biasing force exerted by the outer spring 51*a* and the inner spring 51*b*. By doing so, even if the biasing force from the auxiliary spring 70 is increased, the movement of the control spool 52 which results in the compression of the outer spring 51*a* and the inner spring 51*b* is not caused. As described above, because unintentional movement of the control spool 52 is prevented during the adjustment of the biasing force from the auxiliary spring 70, it is possible to prevent unintentional change of the communicating state between the ports (the first control port 56*a* and the second control port 56*b*) formed in the control spool 52 and the passages (the discharge pressure passage 10 and the control pressure passage 11) formed in the case main body 3*a*.

In addition, with the piston pump 100, because the control spool 52 is directly inserted into the spool accommodating hole 50*a* of the case main body 3*a*, it is possible to suppress the leakage of the working oil, and it is also possible to reduce the number of parts to realize reduction in the size and the cost of the piston pump 100.

Second Embodiment

Next, a second embodiment of the present invention will be described with reference to FIG. 3. In the following, differences from the above-mentioned first embodiment will be mainly described, and components that are the same as those in the above-mentioned first embodiment are assigned the same reference numerals and descriptions thereof will be omitted. Specifically, in the second embodiment, only the configuration of a regulator 150 differs from the configuration of the regulator 50 in the first embodiment, and other configurations are the same.

In the above first embodiment, the auxiliary spring 70 is provided between the seat member 75 and the control spool 52 by extending through the center hole 90*c* of the stopper 90. In addition, the shaft portion 78 of the seat member 75 is inserted into the shaft-portion insertion hole 58*b* of the control spool 52.

Figure 3:
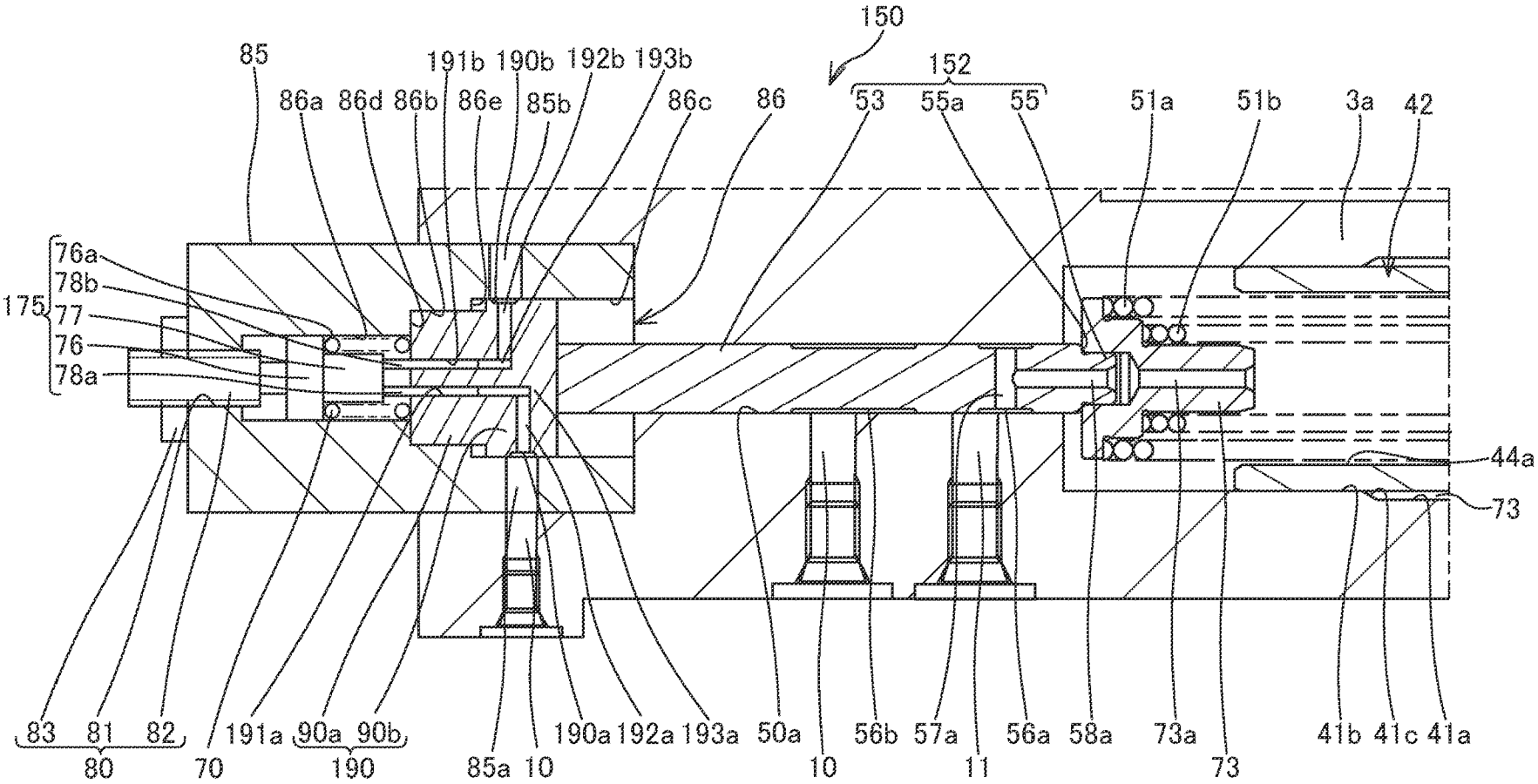
FIG. 3 is a diagram showing the configuration of the regulator of the fluid pressure rotating machine according to a second embodiment of the present invention and is an enlarged sectional view corresponding to FIG. 2.

In contrast, in the regulator 150 of the second embodiment, as shown in FIG. 3, the auxiliary spring 70 is provided between a stopper 190 and a seat member 175 in a compressed state. In the following, the second embodiment will be described in detail.

In the second embodiment, a control spool 152 does not have the flange portion 54, and the shaft-portion insertion hole 58*b* is not provided. An end portion of the control spool 152 on the stopper 190 side is brought into contact with an end surface of the stopper 190.

The one end of the auxiliary spring 70 is seated on an end surface of the stopper 190 on the other side from the control spool 152, and two shaft-portion insertion holes 191*a* and 191*b* are formed so as to extend along the axial direction of the stopper 190. The stopper 190 in this embodiment corresponds to "a spacer member".

The seat member 175 has a pair of shaft portions 78*a* and 78*b* that project out from the support portion 77 in the axial direction. The pair of shaft portions 78*a* and 78*b* are respectively inserted into the pair of shaft-portion insertion holes 191*a* and 191*b* formed in the stopper 190. With such a configuration, the pair of shaft portions 78*a* and 78*b* and inner walls of the shaft-portion insertion holes 191*a* and 191*b* into which the shaft portions 78*a* and 78*b* are respectively inserted form a pair of signal pressure chambers 193*a* and 193*b* to which the signal pressure to be used for the horsepower control is guided.

The one signal pressure chamber 193*a* communicates with the discharge pressure passage 10 via a first communicating port 190*a* that is formed on an outer circumference of the stopper 190, a first connection passage 192*a* that connects the signal pressure chamber 193*a* and the first communicating port 190*a*, and a first cap passage 85*a* formed in the cap 85. The other signal pressure chamber 193*b* communicates with an external pressure passage (not shown) formed in the case main body 3*a* via a second communicating port 190*b* that is formed on the outer circumference of the stopper 190, a second connection passage 192*b* that connects the signal pressure chamber 193*b* and the second communicating port 190*b*, and a second cap passage 85*b* formed in the cap 85. External pump pressure is guided to the external pressure passage as the signal pressure discharged from other hydraulic pump that is driven, together with the piston pump 100, by the motive-power source, for example.

As described above, in this embodiment, although the discharge pressure from the discharge pressure from the piston pump 100 and the discharge pressure from the other hydraulic pump are guided to the signal pressure chambers 193*a* and 193*b* as the signal pressures, the present invention is not limited to this configuration. For example, three or more signal pressure chambers may be formed in the stopper 190, or a single signal pressure chamber may be formed in the stopper 190. In addition, a kind of the signal pressure is not limited to that in the above-mentioned embodiment, and the configuration can be employed arbitrary in accordance with the application, etc. of the piston pump 100. For example, in a case in which the piston pump 100 is a so-called split flow type that discharges the working oil from two ports, the discharge pressure of the working oil discharged from the one port may be guided to the one of signal pressure chambers as the signal pressure, and the discharge pressure of the working oil discharged from the other port may be guided to the other of signal pressure chambers as the signal pressure.

The signal pressures guided to the signal pressure chambers 193*a* and 193*b* respectively act on inner wall portions of the signal pressure chambers 193*a* and 193*b* facing the shaft portions 78*a* and 78*b*. Thus, the control spool 152 receives the signal pressure via the stopper 190 at a pressure receiving area corresponding to the cross-sectional areas of the shaft portions 78*a* and 78*b* (in other words, the cross-sectional areas of the shaft-portion insertion holes 191*a* and 191*b*), and the control spool 152 is biased by the signal pressure in the direction in which the outer spring 51*a* and the inner spring 51*b* are compressed.

Thus, in the piston pump 100 according to this embodiment, the control spool 52 of the regulator 150 is biased, such that the control spool 52 is positioned at the first position, by the biasing force by the discharge pressure (the signal pressure) of the piston pump 100 applied via the stopper 190, the discharge pressure of the other hydraulic pump (the signal pressure) applied by the stopper 190, and the biasing force exerted by the auxiliary spring 70. In addition, the control spool 52 is biased by the biasing force exerted by the outer spring 51*a* and the inner spring 51*b* such that the control spool 52 is positioned at the second position.

In the horsepower control performed by the regulator 150 in the second embodiment, only the number and the kind of the signal pressure that biases the control spool 52 so as to position it at the first position are different from those of the first embodiment, and the other configurations are similar to those of the first embodiment, and therefore, specific descriptions thereof will be omitted.

According to the above-described second embodiment, the advantages described below are afforded.

In the second embodiment, the pair of shaft portions 78*a* and 78*b* are inserted into the stopper 190, and the signal pressure chambers 193*a* and 193*b* are respectively formed by the shaft portions 78*a* and 78*b* in the stopper. By forming the signal pressure chambers 193*a* and 193*b* in the stopper 190 but not in the control spool 52, it is possible to suppress the increase in size of the control spool 52. In addition, because the signal pressure chambers 193*a* and 193*b* are formed in the stopper 190, compared with a case in which the signal pressure chambers 193*a* and 193*b* are formed in the control spool 52, it becomes easier to form the plurality of signal pressure chambers 193*a* and 193*b*. Thus, controlling factors for the horsepower control can be increased with ease, and therefore, it is possible to perform the horsepower control with a higher accuracy.

The configurations, operations, and effects of the embodiments of the present invention will be collectively described below.

The piston pump 100 is provided with: the cylinder block 2 configured to be rotated along with the rotation of the shaft 1; the plurality of cylinders 2*b* formed in the cylinder block 2, the cylinders 2*b* being arranged at predetermined intervals in the circumferential direction of the shaft 1; the pistons 5 respectively slidably inserted into the cylinders 2*b*, the pistons 5 each configured to define the capacity chamber 6 in the interior of the cylinder 2*b*; the tiltable swash plate 8 configured to cause the pistons 5 to reciprocate such that the capacity chambers 6 are expanded and contracted along with the rotation of the cylinder block 2; the first biasing mechanism 30 configured to bias the swash plate 8 in accordance with the control pressure supplied; the second biasing mechanism 40 configured to bias the swash plate 8 against the first biasing mechanism 30; and the regulator 50, 150 configured to control the control pressure guided to the first biasing mechanism 30 in accordance with the self-pressure of the piston pump 100, wherein the regulator 50, 150 has: the outer spring 51*a* and the inner spring 51*b* configured to be extended and compressed by following the tilting of the swash plate 8; the control spool 52 configured to be moved in accordance with the biasing force exerted by the outer spring 51*a* and the inner spring 51*b*, the control spool 52 being configured to adjust the control pressure; the auxiliary spring 70 configured to exert the biasing force to the control spool 52 against the biasing force exerted by the outer spring

51*a* and the inner spring 51*b*; and the adjusting mechanism 80 configured to adjust the biasing force exerted by the auxiliary spring 70.

With this configuration, the control spool 52 of the regulator 50, 150 is moved in accordance with the biasing force exerted by the outer spring 51*a* and the inner spring 51*b* and the biasing force from the auxiliary spring 70 to adjust the control pressure. Thus, by adjusting the biasing force from the auxiliary spring 70 by the adjusting mechanism 80, it is possible to adjust the control characteristic of the regulator 50, 150 and to allow the regulator 50, 150 to exhibit the desired control characteristic. Therefore, the accuracy for the horsepower control of the piston pump 100 is improved.

In addition, in the piston pump 100, the adjusting mechanism 80 is configured to be able to adjust the biasing force from the auxiliary spring 70 within a range not exceeding the biasing force exerted by the outer spring 51*a* and the inner spring 51*b*.

With this configuration, it is possible to prevent the unintentional movement the control spool 52 during the adjustment of the biasing force from the auxiliary spring 70.

In addition, the piston pump 100 is further provided with the case 3 configured to accommodate the cylinder block 2, wherein the case 3 is formed with the spool accommodating hole 50*a* into which the control spool 52 is slidably inserted.

With this configuration, the control spool 52 is slidably inserted into the spool accommodating hole 50*a* of the case 3. As in the comparative example shown in FIG. 4, in a case in which the sleeve 260 is accommodated in the attachment hole 3*e* formed in the case 3 and the control spool 52 is slidably inserted into the sleeve 260, the leakage of the working fluid is caused at between the case 3 and the sleeve 260 and between the sleeve 260 and the control spool 52. Compared with such a case, in the present invention, because the control spool 52 is directly inserted into the case main body 3*a*, it is possible to suppress the leakage of the working oil.

In addition, in the second embodiment, the regulator 150 further has: the stopper 190 provided between the control spool 52 and the auxiliary spring 70; and the signal pressure chambers 193*a* and 193*b* defined by the stopper 190, the signal pressure chambers 193*a* and 193*b* being configured such that the signal pressure biasing the control spool 52 against the biasing force exerted by the outer spring 51*a* and the inner spring 51*b* is guided to the signal pressure chambers 193*a* and 193*b*.

With this configuration, it is possible to change the control characteristic of the regulator 150 by guiding the signal pressure to the signal pressure chamber 193*a*, 193. Thus, by guiding the signal pressure to the signal pressure chambers 193*a* and 193*b* depending on an apparatus to which the piston pump 100 is applied, it is possible to allow the control characteristic to be exhibited in a suitable manner according to the application. In addition, because the signal pressure chambers 193*a* and 193*b* are defined by the stopper 190 that is a separate member from the control spool 52 that controls the control pressure, the processing becomes easier compared with a case in which the signal pressure chambers 193*a* and 193*b* are formed in the control spool 52.

The embodiments of the present invention described above are merely illustration of some application examples of the present invention and the technical scope of the present invention is not limited to the specific constructions of the above embodiments.

The invention claimed is:

1. A fluid pressure rotating machine comprising:

a cylinder block configured to be rotated together with a driving shaft;

a plurality of cylinders formed in the cylinder block, the cylinders being arranged at predetermined intervals in a circumferential direction of the driving shaft;

pistons respectively slidably inserted into the cylinders, the pistons each configured to define a capacity chamber in an interior of the cylinder;

a tiltable swash plate configured to cause the pistons to reciprocate such that the capacity chambers are expanded and contracted;

a first biasing mechanism configured to bias the swash plate in accordance with control pressure supplied;

a second biasing mechanism configured to bias the swash plate against the first biasing mechanism; and a regulator configured to control the control pressure guided to the first biasing mechanism in accordance with self-pressure of the fluid pressure rotating machine, wherein the regulator has:

a biasing member configured to be extended and compressed by following tilting of the swash plate;

a control spool configured to be moved in accordance with a biasing force from the biasing member, the control spool being configured to adjust the control pressure;

an auxiliary biasing member configured to exert a biasing force to the control spool against the biasing force from the biasing member; and an adjusting mechanism configured to adjust the biasing force exerted by the auxiliary biasing member.

2. The fluid pressure rotating machine according to claim 1, wherein the adjusting mechanism is configured to be able to adjust the biasing force from the auxiliary biasing member within a range not exceeding the biasing force exerted by the biasing member.

3. The fluid pressure rotating machine according to claim 2, further comprising a case configured to accommodate the cylinder block, wherein the case is formed with a spool accommodating hole into which the control spool is slidably inserted.

4. The fluid pressure rotating machine according to claim 2, wherein the regulator further has:

a spacer member provided between the control spool and the auxiliary biasing member; and a signal pressure chamber defined by the spacer member, the signal pressure chamber being configured such that signal pressure biasing the control spool against the biasing force from the biasing member is guided to the signal pressure chamber.

5. The fluid pressure rotating machine according to claim 1, further comprising a case configured to accommodate the cylinder block, wherein the case is formed with a spool accommodating hole into which the control spool is slidably inserted.

6. The fluid pressure rotating machine according to claim 1, wherein the regulator further has:

a spacer member provided between the control spool and the auxiliary biasing member; and a signal pressure chamber defined by the spacer member, the signal pressure chamber being configured such that signal pressure biasing the control spool against the biasing force from the biasing member is guided to the signal pressure chamber.

* * * * *